US006354967B1

(12) United States Patent
Nakamura et al.

(10) Patent No.: US 6,354,967 B1
(45) Date of Patent: Mar. 12, 2002

(54) SOLID GOLF BALL

(75) Inventors: Atsushi Nakamura; Hisashi Yamagishi; Takashi Maruko, all of Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 09/487,773

(22) Filed: Jan. 20, 2000

(30) Foreign Application Priority Data

Mar. 3, 1999 (JP) ..... 11-055239

(51) Int. Cl.[7] ..... A63B 37/06
(52) U.S. Cl. ..... 473/378; 473/377
(58) Field of Search ..... 473/377, 378, 473/383, 384, 371, 367, 368

(56) References Cited

U.S. PATENT DOCUMENTS 5,490,673 A * 2/1996 Hiraoka ..... 473/377
5,516,110 A * 5/1996 Yabuki et al. ..... 473/372
5,562,287 A 10/1996 Endo et al. ..... 273/377
5,601,503 A * 2/1997 Yamagishi et al. ..... 473/384
5,607,366 A 3/1997 Yokota et al. ..... 473/372
5,645,496 A * 7/1997 Endo et al. ..... 473/372
5,702,312 A * 12/1997 Horiuchi et al. ..... 473/377
5,776,013 A 7/1998 Yokota et al. ..... 473/377
5,911,639 A * 6/1999 Kasashima et al. ..... 473/377

* cited by examiner

*Primary Examiner*—Mark S. Graham
*Assistant Examiner*—Raeann Gorden
(74) *Attorney, Agent, or Firm*—Sughrue, Mion, PLLC

(57) ABSTRACT

A solid golf ball comprising a core and a cover has a number of dimples in its surface. The core has a deflection of 3.5–5.5 mm when under a load of 100 kg, and has a JIS-C hardness at its surface of at least 70 and a JIS-C hardness at its center which is at least 10 units lower than the hardness at the core surface. The ball, when hit with a driver at a head speed of 50 m/s, has an effective contact area A and an apparent contact area B with the club face such that the ratio A/B is from 0.40 to 0.60. The ball has a soft feel, fully adequate spin characteristics, and excellent control on approach shots, and is well suited for use by golfers having a head speed of less than about 40 m/s.

11 Claims, 1 Drawing Sheet

SOLID GOLF BALL

The present invention relates to a solid golf ball which has an excellent feel when hit with a golf club and provides excellent control on approach shots.

BACKGROUND OF THE INVENTION

Of the large variety of golf balls being manufactured today, solid golf balls predominate as a class because they are able to achieve greater distances than thread-wound golf balls. Included among solid golf balls are various types of golf balls, designed for the average amateur golfer having a low head speed, which contain a softer solid core that holds down spin on the ball and increases the distance of travel. Providing a relatively soft solid core is a high priority with designers of golf balls because it improves the feel of the ball, making it possible for golfers, and especially amateur golfers, to experience a soft feel when striking the ball.

Softening the solid core is known to accordingly lower the resilience of the ball. This loss in resilience has hitherto been compensated for by fabricating solid golf balls using a hard cover stock to form the cover enclosing the solid core.

However, little consideration has been given to the spin characteristics of such solid golf balls on approach shots. On an approach shot aimed at the putting green, even striking the ball with an iron fails to impart sufficient spin, making it impossible to achieve the desired distance or adequate control. The result is poor control on approach shots.

SUMMARY OF THE INVENTION

It is therefore an object of the invention to provide a solid golf ball which has a very good feel and fully adequate spin characteristics, and which provides excellent control on approach shots.

It has been found that a solid golf ball which has been designed to optimize certain parameters, namely, the deflection of the ball's core under a static load of 100 kg, the surface hardness of the core, the difference in hardness between the surface and center of the core, and the ratio A/B between the effective surface area of contact A and the apparent surface area of contact B by the golf ball with the club face when the ball is hit with a driver at a head speed of 50 m/s, provides a soft feel and fully adequate spin characteristics, enabling the golfer to achieve excellent control on approach shots.

More specifically, a golf ball provided with a softer core to give the ball as a whole a good feel when hit must have a hard cover enclosing the core in order to assure a good flight performance. While remaining mindful of this need, the inventor has closely examined the overall hardness of the solid core, the difference in hardness between the surface and center of the core, and the surface area of contact by the ball with the club face on impact, referred to below as the "effective contact area." It has been discovered that a solid golf ball which is designed so that the core has a deflection of 3.5 to 5.5 mm under a static load of 100 kg, the JIS-C hardness at the surface of the core is at least 70, the difference in hardness between the surface and center of the core is at least 10 JIS-C units, and the ratio A/B between the ball's effective contact area A and its apparent contact area B is from 0.40 to 0.60 provides a soft feel when hit and also exhibits fully adequate spin characteristics on approach shots, ensuring an excellent controllability.

Accordingly, the present invention provides a solid golf ball comprising a core and a cover that encloses the core and bearing a number of dimples in its surface. The core has a deflection of 3.5 to 5.5 mm when subjected to a static load of 100 kg. The core has a JIS-C hardness at the surface of at least 70 and a JIS-C hardness at the center which is at least 10 units lower than the hardness at the core surface. The ball, when hit with a driver at a head speed of 50 m/s, has an effective contact area A and an apparent contact area B with the club face such that the ratio A/B is from 0.40 to 0.60.

"Effective contact area," as used herein and shown in FIG. 1, refers to the surface area of contact which accurately represents those places on the surface of the ball that actually come into contact with the club face. It excludes the scattered places in the same general region of the ball's surface which do not actually come into contact with the club face, such as dimple recesses. "Apparent contact area," as shown in FIG. 3, is used herein to refer to the entire surface area of the general region of the ball that comes into contact with the club face. This quantity includes scattered places within this region where the surface of the ball does not actually come into contact with the club face, such as dimple recesses. That is, when a circular or elliptical region of the ball contacts the club face, the surface area of this circular or elliptical region is the apparent contact area. Subtracting from this apparent contact area the surface area of those places such as dimple recesses where the surface of the ball does not actually come into contact with the club face yields the effective contact area.

Mention is made of "contact area" in JP-A 7-112036, for example. However, the "contact area" in these patents denotes the overall surface area computed by such means as elliptical approximation or blacking in of the general region of contact on the ball. This has the same meaning as apparent contact area B used in the present invention, but differs in meaning from effective contact area A as used herein.

In the golf ball of the invention, the use of a cover having a Shore D hardness of not more than 65 to enclose the core is preferable for enhancing the spin characteristics of the ball. Also, the percent of the ball's surface covered by the dimples formed thereon, referred to hereinafter as the "dimple surface coverage," is preferably at least 71%.

The spin characteristics of the ball when hit with a golf club are closely associated with the surface area of contact by the ball with the club face. In fact, it is described in JP-A 9-135923 that the spin characteristics improve as the contact surface area becomes larger. Hence, golf balls are being designed with a reduced dimple surface coverage to achieve good spin characteristics. Unfortunately, balls designed with a reduced dimple surface coverage cease to make effective use of the dimple aerodynamics, resulting in a decline in the flight performance of the ball. However, it has been found that by setting within a range of 0.40 to 0.60 the above-described ratio A/B between the effective contact area A and the apparent contact area B by the ball on the club face when the ball is hit, the dimple surface coverage can be increased, enabling the dimple aerodynamics to be fully exploited and thus enhancing the flight performance of the ball.

It is recommended that the dimples formed on the surface of the solid golf ball of the invention be of at least two types and have a mean diameter $D_m$ and a mean depth $D_p$ such that the ratio $D_m/D_p$ is from 23 to 30. This enables even more effective use to be made of the dimple aerodynamics, further enhancing the flight performance of the ball.

DETAILED DESCRIPTION OF THE INVENTION

Figure 1:
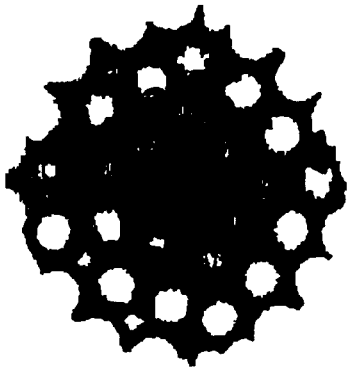
FIG. 1 is an image illustrating the region of the golf ball that comes into contact with the club face when a golf ball is hit.

The solid golf ball of the present invention may have a known solid golf ball construction such as a two-piece construction or a multi-piece construction composed of three or more layers. No particular limitation is imposed on the construction of the ball so long as it comprises a core and a cover.

The core of the inventive ball may be either a solid core or a thread-wound core and made of known materials. For example, the solid core may be formed of a rubber composition comprising a base rubber, co-crosslinking agent, peroxide and other ingredients as commonly employed in conventional solid cores. Preferably cis-1,4-polybutadiene rubber is used as the base rubber in order to achieve high resilience.

The solid core used herein may be either a single-layer core or a multilayer core. Deflection of the core under a static load of 100 kg must be set within a range of 3.5 to 5.5 mm, preferably 3.7 to 5.0 mm, and most preferably 3.9 to 4.8 mm. A core deflection of less than 3.5 mm gives the ball a hard feel and fails to provide an increased distance when the ball is hit at a relatively low club head speed. A deflection greater than 5.5 mm results in a poor ball resilience and reduced distance. The core preferably has a diameter of 37.6 to 40.6 mm, and especially 38.0 to 39.5 mm.

It is critical that the core have a JIS-C hardness at the surface of at least 70, and preferably within a range of 70 to 77. A surface hardness of less than 70 allows the core to be deformed together with the cover when the ball is hit with a club, preventing the dimples near the center of the region on the ball's surface that comes into contact with the club face from achieving sufficient contact with the club face.

The core hardness must also be such that the hardness at the core surface is at least 10 JIS-C units, and preferably at least 12 units, higher than the hardness at the center of the core. A hardness difference of less than 10 units leads to the shortage of surface hardness, even if the core's deflection under a static load of 100 kg falls within the above-specified range, so that the dimples near the center of the region on the ball's surface that comes into contact with the club face cannot achieve sufficient contact. It is noted that the hardness of the core at its surface and the hardness of the core at its center are sometimes referred to as surface hardness and center hardness, respectively.

The center hardness of the core is not subject to any particular limitation, provided it is adjusted so that the difference in JIS-C hardness between the surface and the center of the core is at least 10 units. The center hardness of the core is preferably within a range of 55 to 62 in JIS-C hardness.

The cover enclosing the core may have either a single-layer or multilayer construction. Preferably the cover has a Shore D hardness at the surface of 30 to 65, more preferably 35 to 60, and most preferably 40 to 58. A Shore D hardness of less than 30 may result in poor ball resilience and reduced distance. On the other hand, at a Shore D hardness greater than 65, the cover may become so hard as to adversely affect the spin characteristics of the ball and also prevent sufficient contact by the dimples near the center of the region on the ball's surface that comes into contact with the club face.

If the cover is given a two-layer construction composed of an inner layer and an outer layer, it is preferable for the inner layer to have a Shore D hardness of at least 65.

The cover of the inventive ball may be made of suitable known materials such as ionomer resins and thermoplastic elastomers.

The cover has a thickness within a conventional range, preferably from 1.0 to 2.5 mm, more preferably from 1.4 to 2.3 mm, and most preferably from 1.6 to 2.1 mm. A cover thickness of less than 1.0 mm may fail to provide the ball with resilience and durability, whereas a thickness greater than 2.5 mm can make the cover so rigid as to prevent sufficient contact by the dimples near the center of the region on the ball's surface that comes into contact with the club face.

The cover has a large number of dimples formed on the surface thereof. The number of dimples may be set at 360 to 460, and especially 370 to 450. The dimples may all have the same diameter and depth, although dimples may be present in two or more types of differing diameter and/or depth. The dimples may have a diameter of 1.0 to 5.0 mm, and especially 2.0 to 4.5 mm, and a depth of 0.100 to 0.250 mm, and especially 0.110 to 0.230 mm. It is recommended that at least two types of dimples be formed on the surface of the ball, and that the average diameter $D_m$ and average depth $D_p$ of the dimples be such that the ratio $D_m/D_p$ is from 23/1 to 30/1, and especially from 25/1 to 30/1. If $D_m/D_p$ is less than 23, the dimples may be too deep to allow sufficient contact by the dimples near the center of the region on the ball's surface that comes into contact with the club face. On the other hand, if $D_m/D_p$ is greater than 30, on long shots with a driver, for example, the trajectory of the ball becomes so steep that the ball describes a high arc in flight, resulting in a shorter distance of travel.

The arrangement of the dimples is not critical. Use may be made of any suitable known arrangement, such as a regular octahedral, regular dodecahedral or regular icosahedral arrangement.

No particular limitation is imposed on the percent of the ball's surface covered by the dimples formed thereon, although this dimple surface coverage is preferably at least 71%, and especially at least 73%. A dimple surface coverage of less than 71% may enable the effective contact area A to be increased, but fail to provide sufficient dimple effects and hence, excellent flight performance. The upper limit to the dimple surface coverage is generally, though not necessarily, 86%.

The expression "dimple surface coverage" used herein refers to the ratio, expressed as a percentage, of the combined surface area obtained by adding together the area of the planar surface circumscribed by the edge of the opening for each of the many dimples formed on the ball's surface to the area of the imaginary spherical surface that corresponds to the surface of the ball when the dimples are disregarded.

The golf ball of the invention is fabricated such that when the ball is hit with a driver at a head speed of 50 m/s, the ratio A/B between the effective contact area A and the apparent contact area B of the ball at the time of impact is from 0.40/1 to 0.60/1, and preferably from 0.42/1 to 0.58/1. If A/B is less than 0.40, the effective contact area A is insufficient to provide good spin characteristics. At a value of A/B larger than 0.60, the spin characteristics are improved but the distance traveled by the ball decreases.

Figure 2:
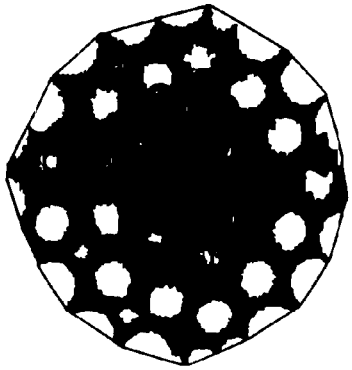
FIG. 2 shows the image in FIG. 1 that has been trimmed.
Figure 3:
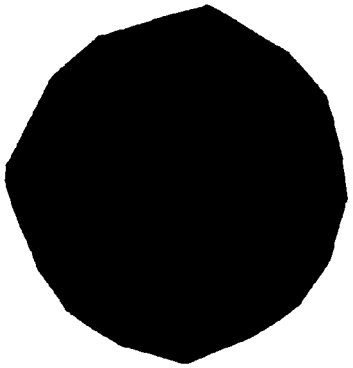
FIG. 3 shows the image in FIG. 2 that has been blacked in for the purpose of determining the apparent contact area B.

The effective contact area A and the apparent contact area B are determined by using pressure-sensitive paper to measure the deformed region when the golf ball is hit. More specifically, measurement is preferably made by the following method which is designed so as to eliminate the influence of score lines on the club face when the ball is hit. To a titanium plate having a weight of 220 g which is shaped as a disk having a diameter of 9 cm and a thickness of 0.8 cm, a pressure-sensitive paper (Fuji Film. Prescale pressure-sensitive paper for moderate pressure, manufactured by Fuji Photo Film Co., Ltd.) is affixed. The golf ball is shot with an air cannon against the titanium plate at an initial velocity of 50 m/s. An image of the area of contact by the ball is impressed on the surface of the paper as shown in FIG. 1. As can be seen in FIG. 1, because the normally round dimples are recessed, areas where the surface of ball does not actually contact the club face (the white areas in the diagram) are scattered over the image. The image is then peripherally bounded or "trimmed" to give an approximately circular image, as shown in FIG. 2. The interior of this trimmed image is then completely blacked in as shown in FIG. 3, giving the image used to measure the apparent contact area B.

The effective contact area A and the apparent contact area B can then be computed by scanning the images obtained as described above (FIGS. 1 and 3) into a computer, followed by image processing (digitization). The effective contact area A thus determined is preferably from 2.0 to 3.9 $cm^2$, and especially 2.1 to 3.8 $cm^2$. The apparent contact area B is preferably from 5.0 to 6.5 $cm^2$, and especially from 5.2 to 6.2 $cm^2$. The effective contact area A and apparent contact area B within these ranges must also be such that the ratio A/B is from 0.40 to 0.60. By setting the ratio A/B between 0.40 and 0.60, the dimples near the center of the region of contact on the ball's surface do in fact collapse, so that even those places that are normally dimples come into contact with the club face, increasing the surface area of contact. On the other hand, dimples at the periphery of the region of contact remain in a non-contact state.

A measurement method as described above is used to eliminate the influence of score lines. It has been ascertained that, aside from the presence or absence of score lines, the contact area when a ball is actually hit with a driver and the contact area obtained by this measurement method are in fact the same when the head speed of the driver and the initial velocity are identical. Accordingly, this measurement method provides an acceptable model of the surface area of contact when a golf ball is struck with a driver at a head speed of 50 m/s.

The above value of A/B can be adjusted as desired by the appropriate selection of a number of variables, including core deflection under a static load of 100 kg, surface hardness of the core, difference between surface hardness and center hardness of the core, hardness and thickness of the cover, and dimple configuration.

The solid golf ball of the invention can be produced by a known method appropriate to the type and construction of the ball. For example, production may be carried out by injection molding the cover stock about the core, or by closing a pair of preformed half-cups over the core then molding under heat and pressure.

The diameter, weight and other parameters of the solid golf ball thus obtained may be suitably selected in accordance with the Rules of Golf.

The solid golf ball of the invention has a soft feel when hit as well as good spin characteristics, thus providing excellent control on approach shots. The inventive golf ball lends itself especially well to use by golfers having a head speed of less than about 40 m/s.

EXAMPLE

Examples of the invention and comparative examples are given below by way of illustration, and are not intended to limit the invention.

Examples 1–4 and Comparative Examples 1–3

In each Example, the core rubber composition formulated as shown in Table 1 was blended in a kneader and vulcanized in a core mold to form a solid core.

A cover was injection-molded around each of the resulting cores from the respective cover stock materials shown in Table 1, thereby giving solid golf balls for Examples 1 to 4 and Comparative Examples 1 to 3.

At the same time as injection molding, dimples in one of the three sets of configurations shown below in Table 2 (I to III) were formed on the surface of the respective covers.

The physical properties and characteristics of the golf balls obtained in the examples were measured and evaluated as described below. The results are presented in Table 1.

Core Hardness

Measured as the deflection of the core under a static load of 100 kg.

Effective and Apparent Contact Areas A and B

The golf ball was shot with an air cannon against a titanium plate having a weight of 220 g at an initial velocity of 50 m/s. The effective contact area A and apparent contact area B were determined by the method described above using a piece of pressure sensitive paper (Fuji Film Prescale for moderate pressure, manufactured by Fuji Photo Film Co., Ltd.) affixed beforehand to the plate.

Flight Performance

The golf balls in each example were measured for carry and total distance when shot with a driver (No. 1 wood) at a head speed of 35 m/s (HS35) using a swing robot.

Approach Control

The controllability of the ball on approach shots when hit with a pitching wedge was rated as "Good" or "Poor" by five professional and top amateur golfers.

TABLE 1

| Ingredients (parts by weight) | | EX 1 | EX 2 | EX 3 | EX 4 | CE 1 | CE 2 | CE 3 |
|---|---|---|---|---|---|---|---|---|
| Core | cis-1,4-Polybutadiene rubber | 100 | 100 | 100 | 100 | 100 | 100 | 100 |
| | Zinc diacrylate | 20.7 | 19.2 | 17.0 | 14.5 | 30.0 | 5.5 | 23.8 |
| | Barium sulfate | 19.4 | 20.0 | 21.0 | 22.1 | 15.2 | 26.0 | 18.0 |
| | Zinc oxide | 5 | 5 | 5 | 5 | 5 | 5 | 5 |
| | Antioxidant | 0.2 | 0.2 | 0.2 | 0.2 | 0.2 | 0.2 | 0.2 |
| | Dicumyl peroxide | 1.2 | 1.2 | 1.2 | 1.2 | 1.2 | 1.2 | 1.2 |

TABLE 1-continued

| Ingredients (parts by weight) | | EX 1 | EX 2 | EX 3 | EX 4 | CE 1 | CE 2 | CE 3 |
|---|---|---|---|---|---|---|---|---|
| Cover | Himilan 1557*1 | 50 | 50 | 50 | 50 | 50 | — | 50 |
| | Himilan 1605*1 | — | — | — | 50 | — | — | — |
| | Himilan 1601*1 | — | — | 50 | — | — | — | 50 |
| | Himilan 7315*1 | — | — | — | — | — | 50 | — |
| | Surlyn 8120*2 | 50 | 50 | — | — | 50 | — | — |
| | Surlyn 8220*2 | — | — | — | — | — | 50 | — |
| | Titanium white | 5 | 5 | 5 | 5 | 5 | 5 | 5 |
| | Magnesium stearate | 0.3 | 0.3 | 0.3 | 0.3 | 0.3 | 0.3 | 0.3 |
| Core diameter (mm) | | 38.9 | 38.9 | 38.9 | 38.9 | 38.9 | 38.9 | 38.9 |
| Core weight (g) | | 35.7 | 35.7 | 35.7 | 35.7 | 35.7 | 35.7 | 35.7 |
| Core deflection under 100 kg load (mm) | | 4.0 | 4.2 | 4.5 | 4.8 | 2.8 | 6.0 | 3.6 |
| Core surface JIS-C hardness | | 76.0 | 74.0 | 72.0 | 70.0 | 82.0 | 65.0 | 70.0 |
| Core center JIS-C hardness | | 59.0 | 59.0 | 58.0 | 56.0 | 65.0 | 52.0 | 68.0 |
| Hardness difference (surface – center) | | 17.0 | 15.0 | 14.0 | 14.0 | 17.0 | 13.0 | 2.0 |
| Cover Shore D hardness | | 50 | 50 | 58 | 60 | 50 | 67 | 58 |
| Cover thickness (mm) | | 1.9 | 1.9 | 1.9 | 1.9 | 1.9 | 1.9 | 1.9 |
| Ball weight (g) | | 45.3 | 45.3 | 45.3 | 45.3 | 45.3 | 45.3 | 45.3 |
| Dimple set | | I | I | II | II | I | II | III |
| Dimple surface coverage (%) | | 75.0 | 75.0 | 78.6 | 78.6 | 75.0 | 78.6 | 67.6 |
| $D_m/D_p$ | | 26.6 | 26.6 | 28.4 | 28.4 | 26.6 | 28.4 | 20.5 |
| Effective contact area A ($cm^2$) | | 2.86 | 2.69 | 2.84 | 2.52 | 2.75 | 2.37 | 2.03 |
| Apparent contact area B ($cm^2$) | | 5.5 | 5.6 | 5.8 | 6.0 | 5.0 | 6.4 | 5.2 |
| A/B | | 0.52 | 0.48 | 0.49 | 0.42 | 0.55 | 0.37 | 0.39 |
| Carry (m) at HS35 | | 137.0 | 138.5 | 139.0 | 137.5 | 134.0 | 136.0 | 137.0 |
| Total distance (m) at HS35 | | 155.0 | 157.2 | 156.0 | 154.0 | 150.5 | 156.0 | 154.5 |
| Approach control | | Good | Good | Good | Good | Good | Poor | Poor |

*1An ionomer resin manufactured by DuPont-Mitsui Polychemicals Co., Ltd.
*2An ionomer resin manufactured by E. I. DuPont de Nemours and Co.

TABLE 2

| | Dimples | | | | | | | |
|---|---|---|---|---|---|---|---|---|
| Set | Diameter (mm) | Depth (mm) | Number by type | Total number | Average diameter $D_m$ (mm) | Average depth $D_p$ (mm) | $D_m/D_p$ | Dimple surface coverage (%) |
| I | 4.000 | 0.135 | 62 | 432 | 3.525 | 0.133 | 26.6 | 75.0 |
| | 3.700 | 0.135 | 210 | | | | | |
| | 3.300 | 0.130 | 50 | | | | | |
| | 3.100 | 0.130 | 110 | | | | | |
| II | 4.000 | 0.130 | 132 | 432 | 3.475 | 0.123 | 28.4 | 78.6 |
| | 3.700 | 0.130 | 180 | | | | | |
| | 3.300 | 0.115 | 60 | | | | | |
| | 2.900 | 0.115 | 60 | | | | | |
| III | 4.150 | 0.190 | 54 | 360 | 3.783 | 0.185 | 20.5 | 67.6 |
| | 3.700 | 0.185 | 174 | | | | | |
| | 3.500 | 0.180 | 132 | | | | | |

As is apparent from the results in Table 1, the solid golf balls of Examples 1 to 4 all had a good flight performance when hit at a low head speed of 35 m/s, and were well controllable on approach shots. By contrast, the solid golf ball obtained in Comparative Example 1 had a poor flight performance, and the balls obtained in Comparative Examples 2 and 3 were poorly controllable on approach shots. Hence, none of the balls obtained in the comparative examples were advantageous for making approach shots. The most likely reasons why these comparative balls fail to provide satisfactory results are excessive hardness of the core in Comparative Example 1, the combination of an excessively soft core and a hard cover in Comparative Example 2, and a poor core hardness distribution resulting in a small effective contact area A in Comparative Example, 3.

Japanese Patent Application No. 11-055239 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A solid golf ball comprising a core formed of a rubber composition and a cover that encloses the core and bearing a number of dimples in its surface, wherein the core has a deflection of 3.5 to 5.5 mm under an applied load of 100 kg, the core having a surface and a center has a JIS-C hardness at the surface of at least 70 and a JIS-C hardness at the center which is at least 10 units lower than the hardness at the core surface, the cover has a Shore D hardness of not more than 65 at the surface thereof, and the ball, when hit with a driver having a club face at a head speed of 50 m/s, has an effective contact area A and an apparent contact area B with a club face such that the value of A/B is from 0.40 to 0.60.

2. The solid golf ball of claim 1, wherein the ball has a dimple surface coverage of at least 71%.

3. The solid golf ball of claim 1, wherein the dimples are of at least two types and have an average diameter $D_m$ and an average depth $D_p$ such that the value of $D_m/D_p$ is from 23 to 30.

4. The solid golf ball of claim 1, wherein the core at the center has a JIS-C hardness of 55 to 62.

5. The solid golf ball of claim 1, wherein the core has a diameter of 37.6 to 40.6 mm.

6. The solid golf ball of claim 1, wherein the effective contact area A and the apparent contact area B are from 2.0 to 3.9 $cm^2$ and 5.0 to 6.5 $cm^2$, respectively.

7. The solid golf ball of claim 1, wherein the cover is made of materials selected from ionomer resins and thermoplastic elastomers and has a Shore D hardness at the surface of 35 to 60.

8. The solid golf ball of claim 1, wherein the number of dimples is in a range of 360 to 460.

9. The solid golf ball of claim 3, wherein said dimples are composed of dimples which are formed of four different diameters and two different depths.

10. The solid golf ball of claim 3, wherein said dimples are composed of the dimples which are formed of three different diameters and three different depths.

11. The solid golf ball of claim 1, wherein the cover is formed of a two-layer construction composed of an inner layer and an outer layer and the inner layer has a Shore D hardness of at least 65.

* * * * *